US007896226B1

(12) United States Patent
Branan et al.

(10) Patent No.: US 7,896,226 B1
(45) Date of Patent: Mar. 1, 2011

(54) SECURE MAIL BOX

(76) Inventors: Scott C. Branan, Dallas, TX (US); Charles L. Branan, Dallas, TX (US)

( * ) Notice: Subject to any disclaimer, the term of this patent is extended or adjusted under 35 U.S.C. 154(b) by 64 days.

(21) Appl. No.: 12/456,755

(22) Filed: Jun. 22, 2009

Related U.S. Application Data

(63) Continuation-in-part of application No. 12/011,324, filed on Jan. 25, 2008, now Pat. No. 7,549,572.

(60) Provisional application No. 60/897,804, filed on Jan. 26, 2007.

(51) Int. Cl.
*B65G 11/04* (2006.01)

(52) U.S. Cl. ..... 232/45; 232/47; 232/52

(58) Field of Classification Search ..... 232/45, 232/47–52, 17, 44; 109/66–68; 220/826, 220/846

See application file for complete search history.

(56) References Cited

U.S. PATENT DOCUMENTS 3,519,198 A 7/1970 Benoliel
5,526,979 A 6/1996 Mann
5,979,751 A 11/1999 Maddox
5,992,736 A 11/1999 Parker
6,244,505 B1 6/2001 Grimes et al.
6,299,061 B1 10/2001 Henson
6,644,542 B2 11/2003 Cox et al.
6,655,577 B2 12/2003 Mihaylov et al.
6,976,620 B2 12/2005 Swider
7,040,529 B2 5/2006 Swider et al.
7,428,980 B2 * 9/2008 Irwin et al. ..... 232/45

* cited by examiner

*Primary Examiner* — William L. Miller

(74) *Attorney, Agent, or Firm* — Roger N. Chauza, PC

(57) ABSTRACT

A mail box having a depository vault overlying a secure compartment. A mail deposit platform and a flag door are independently rotatable with respect to each other to open and close a mail deposit opening in the depository vault. The mail deposit platform receives mail in the depository vault. If the mail placed on the mail platform is incoming mail, the platform is rotated to transfer the incoming mail to the underlying secure compartment, as well as to close the mail deposit opening. If the mail placed on the platform is outgoing mail, the flag door is rotated to close the mail deposit opening and to provide an indication to the postman that the mail is to be picked up and delivered to the destination.

20 Claims, 12 Drawing Sheets

SECURE MAIL BOX

RELATED APPLICATION

This U.S. non-provisional patent application is a continuation-in-part of U.S. patent application Ser. No. 12/011,324 filed Jan. 25, 2008, now U.S. Pat. No. 7,549,572, which application claims the benefit of U.S. provisional patent application filed Jan. 26, 2007, and accorded Ser. No. 60/897,804.

TECHNICAL FIELD OF THE INVENTION

The present invention relates in general to mail boxes, and more particularly to mail boxes of the type having a secure mail receiving compartment.

BACKGROUND OF THE INVENTION

Mail boxes serve the primary purpose of providing temporary storage for mail between a sender and a recipient. Some mail boxes are needed only to receive mail until retrieved by the recipient. This is the case with mail boxes provided by the U.S. Postal Service at a central mail center, and other private mail box service providers. In these situations, outgoing mail is deposited by the sender at other mail repositories, such as separate outgoing mail slots of the central mail station, or free standing inside or outside U.S. mail boxes. Other mail boxes serve both as repositories for incoming and outgoing mail. Traditional residential mail boxes and rural mail boxes are of this type. The person assigned to the mail box simply places outgoing main in the mail box, places the flag in the up position, whereupon the mailman picks up the mail before depositing incoming mail in the same mail box. Conventional mail boxes of this type have a hinged lid to open and close the mail box and maintain the incoming and the outgoing mail free from the elements, such as rain, wind, snow, etc.

While the foregoing mail boxes serve their functions, they are not without various disadvantages. A primary concern with mail boxes these days is the security of the mail so that an unauthorized person does not gain access to the mail deposited in the mail box. With the increasing incidents of identity theft, and when mail often includes important information such as social security numbers, bank account numbers, passwords, etc., it is of paramount importance that mail passing through the U.S. Postal Service is maintained as secure as possible so that such private information remains confidential and not available to unauthorized parties.

Various mail boxes have been devised to improve the security of the mail deposited therein. Secure mail boxes are disclosed in U.S. Pat. Nos. 5,526,979 by Mann; 5,979,751 by Maddox; 5,992,736 by Parker; 6,244,505 by Grimes et al.; 6,299,061 by Henson; 6,655,577 by Mihaylov et al; 6,644,542 by Cox et al; 6,976,620 by Swider and 7,040,529 by Swider et al. However, these mail boxes involve numerous disadvantages and shortcomings.

Many of these prior art mail boxes employ either a hinged door or sliding tray that is movable outwardly away from the mail box in order to retrieve or deposit mail therein. The movement of the hinged door or sliding tray toward the person or mailman, makes the deposit of mail inconvenient. In other words, the person must stand some distance away from the mail box in order to allow the door or tray to be fully deployed outwardly. This is especially inconvenient in areas where the mail is delivered by a mailman using a vehicle. In this situation, the mailman must be careful not to drive the vehicle too close to the mail box, otherwise the door or tray of the mail box would strike the vehicle when opened fully.

Another disadvantage of the prior art mail boxes is that when equipped with hinged doors, the movement of the door to place outgoing mail on the bed moves the mail bed. In other words, when the person desires to mail a letter, the mail bed moves or rotates in unison with the opening or closing of the door to the mail box. This arrangement requires other complicated equipment and mechanisms to be employed so that when the postman picks up the outgoing mail, the opening of the door to the mail box does not inadvertently deposit the outgoing mail in the secure compartment underlying the rotatable mail bed.

From the foregoing, it can be seen that a need exists for an improved mail box that overcomes the problems and shortcomings of the prior art mail boxes. A need exists for a mail box in which access to the internal portion thereof for depositing either incoming or outgoing mail involves the movement of one or more doors sideways, rather than outwardly toward the person. Yet another need exists for a mail box having a door arrangement in which the mail bed does not move or rotate when the door is opened to deposit incoming or outgoing mail thereon.

SUMMARY OF THE INVENTION

In accordance with the principles and concepts of the invention, disclosed is a mail box with a barrel-shaped depository vault providing access thereto via a mail deposit opening by one or more doors which pivot or rotate with respect to each other. Also disclosed is an improved mail box equipped with a mail platform and a flag door, where the flag door does not rotate the platform on which mail is deposited.

The mail box according to one embodiment of the invention includes a planar mail platform with a semi-cylindrical bottom portion. When mail platform is rotated to deposit incoming mail into an underlying secure compartment, a portion of the semi-cylindrical bottom covers the mail deposit opening in the barrel-shaped vault. The mail platform can remain in the rotated position to keep weather elements from entering the depository vault. For outgoing mail, mail can be deposited onto the mail platform, and the flag door is rotated to the closed position to close the opening in the mail box, without rotating the platform on which the outgoing mail rests. The flag door preferably includes an indication, such as a red color, to provide a visual indication to the postman that outgoing mail is present in the mail box.

According to another feature of the invention, the mail platform and the flag door are made rotatable about the same axis, but such components of the mail box are rotatable independently of each other. A curved portion of the mail platform is rotatable with the planar platform to cover the mail deposit opening in the depository vault so that a person cannot gain access via the mail deposit opening to the mail transferred to the underlying secure compartment.

In accordance with one embodiment of the invention, disclosed is a mail box equipped with a barrel-shaped depository vault having a cylindrical body with closed ends, where the cylindrical body has a bottom mail drop opening and a mail deposit opening in the cylindrical body for depositing mail in the depository vault. Further included is a secure incoming compartment underlying the bottom mail drop opening. The secure incoming compartment includes a door for retrieving mail from the secure incoming compartment. An arcuate-shaped flag door is rotatable about an axis to open and close the mail deposit opening in the cylindrical body of the depository vault. A mail platform is rotatable about the same axis as the arcuate-shaped flag door, and the mail platform is located to receive mail thereon via the mail deposit opening in the cylindrical body of the depository vault. A cylindrical portion is attached to the mail platform, and the cylindrical portion is adapted for covering the mail deposit opening in the cylindrical body when the mail platform is rotated to drop mail from the mail platform into the underlying secure incoming compartment. A flag door handle is attached to the flag door for rotating the flag door, and a mail deposit handle is attached to the mail platform to rotate the platform.

In accordance with another embodiment of the invention, disclosed is a mail box having a flag door handle, a mail deposit handle, a first axle and a second axle. A barrel-shaped depository vault has opposing first and second side panels, where the first axle extends from a bore in one first side panel, and the mail deposit handle is attached to the first axle, and the second axle extends from a bore in the second side panel, and the flag door handle is attached to the second axle. A secure incoming compartment underlies a mail drop opening in the depository vault, and a mail platform is attached to the first axle. The mail platform has a planar surface extending diametrically within the barrel-shaped depository vault, and the mail deposit handle is effective to rotate the mail platform and transfer mail from the mail platform to the secure incoming compartment. A flag door is operable by the flag door handle for covering and uncovering a mail deposit opening in the barrel-shaped depository.

In accordance with one embodiment of the invention, disclosed is a method of using a mail box. The method includes rotating a mail platform of the mail box to uncover a mail deposit opening in the mail box, thereby allowing mail to be deposited via the mail deposit opening onto the mail platform located within a depository vault of the mail box. Outgoing mail is deposited onto the mail platform vault and a flag door is rotated to a closed position to close the mail deposit opening in the mail box. The flag door is moved to the open position to retrieve the outgoing mail deposited on the platform; and incoming mail is deposited on the mail platform. The mail platform is rotated to thereby drop the incoming mail into a secure compartment located below the depository vault, and the mail platform is left in the rotated position so that a portion of the mail platform closes the mail deposit opening.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions, elements throughout the views, and in which.

DETAILED DESCRIPTION OF THE INVENTION

Figure 1:
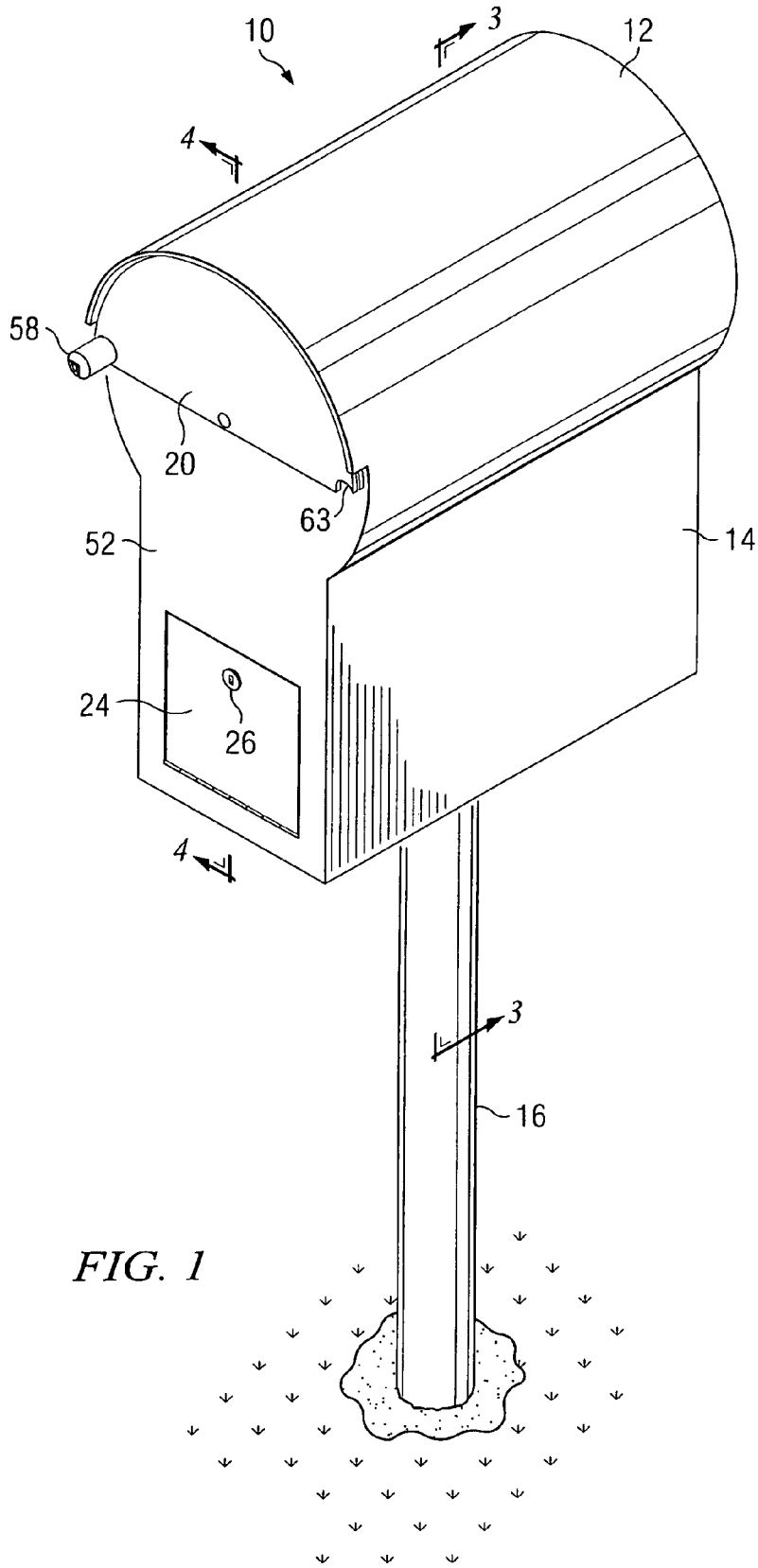
FIG. 1 is an isometric view of a mail box constructed according to the invention.
Figure 2:
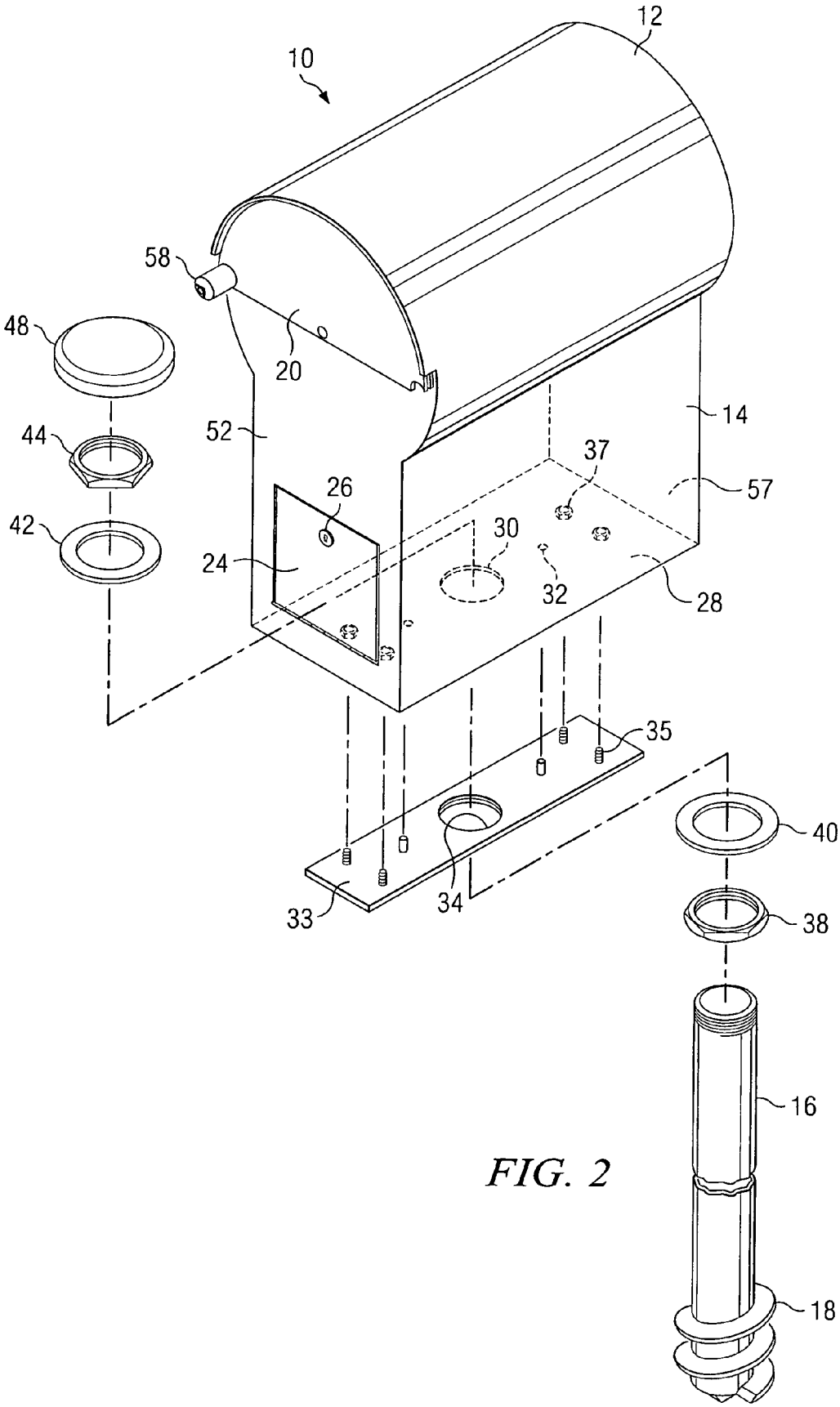
FIG. 2 is an exploded view of the mail box of the invention, illustrating the manner in which the mailbox is attached to a post anchored in the ground.

With reference to FIG. 1, there is shown a mailbox 10 constructed according to the preferred embodiment of the invention. The mailbox 10 includes a depository vault 12 attached to a secure incoming compartment 14. The depository vault 12 and the secure incoming compartment 14 are preferably constructed of sheet metal, either in one piece formed in the shape shown, or as two separate units that are bolted or welded together. The bottom of the secure incoming compartment 14 is fastened to a stand 16 that is anchored in the ground by an auger 18, as shown in FIG. 2. The stand 16 can also be used without an auger 18, and anchored in the ground in a conventional manner. The depository vault 12 includes a rotatable main door 20 to close or open a semicircular opening formed in the front of the depository vault 12. The main door 20 is rotatable clockwise about a central horizontal axis to an open position for either depositing outgoing mail in the depository vault 12, or for depositing incoming mail therein by a postman. As will be described in more detail below, the incoming mail deposited by a postman is initially placed on a platform 22 (FIG. 3) that rotates with the main door 20, and when the main door 20 is rotated CCW to a closed position, the mail drops downwardly into the secure incoming compartment 14. When the mail drops in the secure incoming compartment 14, it cannot otherwise be retrieved or obtained, except by access via a locked compartment door 24. The lockable compartment door 24 can be opened by use of a conventional key and lock 26 so that the user of the mailbox can retrieve the incoming mail from the secure incoming compartment 14.

With reference to FIG. 2, there is shown an exploded view of the major components of the mailbox 10 according to the invention. The depository vault 12 is barrel-shaped with a closed back, and with a semicircular top opening in the front, shown covered by the rotatable main door 20. The bottom semicircular portion of the front of the depository vault 12 is covered with sheet metal. The secure incoming compartment 14 is generally box-shaped and formed or otherwise fastened to the bottom of the depository vault 12. The secure incoming compartment 14 is constructed with four sides and a bottom 28, but no top. The bottom 28 of the secure incoming compartment 14 has a central hole 30 formed therein. Two other registration holes, one shown as numeral 32, are also formed in the bottom 28 of the secure incoming compartment 14.

The mailbox 10 is attached to a stand 16. The stand 16 includes a pipe that is threaded on the top end and has an auger 18 fastened to the bottom end. A base plate 33 formed of a heavy duty metal can be fastened to the top of the stand 16 by first threading a large nut 38 onto the threads of the stand 16, and then placing a large washer 40 on top of the nut 38. The base plate 33 is then placed on the stand by aligning the threaded hole 34 of the base plate 33 with the stand 16 and threading it onto the pipe 16 on top of the washer 40. Temporarily, the base plate 33 can be fastened to the stand 16 by placing a top washer 42 on the base plate 33 and fastening it to the stand 16 with a top nut 44. The base plate 33 is essentially sandwiched between the bottom nut 38 and the top nut 44.

As an alternative to the foregoing manner of attaching the mailbox 10 to the stand 16, the base plate 33 can be welded or otherwise made integral with the stand 16. With this arrangement, the base plate 33 would have threaded studs, one shown as numeral 35, fastened thereto and protruding upwardly. The bottom 28 of the secure incoming compartment 14 would have four holes therein to receive the respective threaded studs 35. The mail box 10 would be fastened to the base plate 33 by screwing nuts 37 onto the threaded studs 35. Access to the threaded studs 35 would be through the secure incoming compartment 14.

Figure 5A:
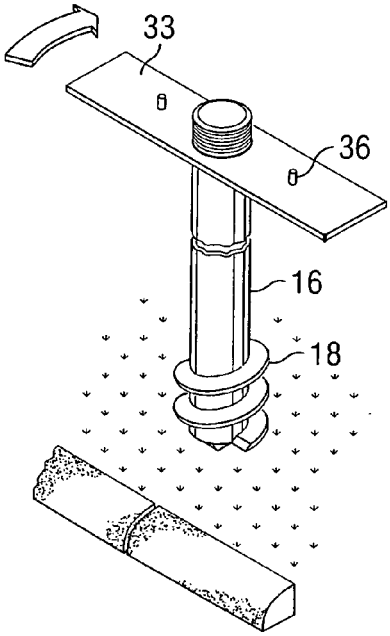
FIGS. 5*a*-5*c* illustrate the steps in installing the mail box along a curb.
Figure 5B:
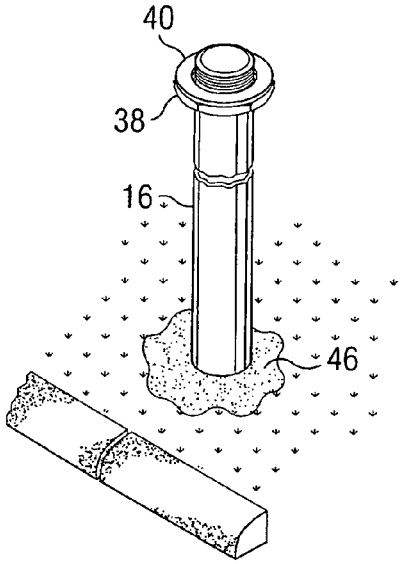
Figure 5C:
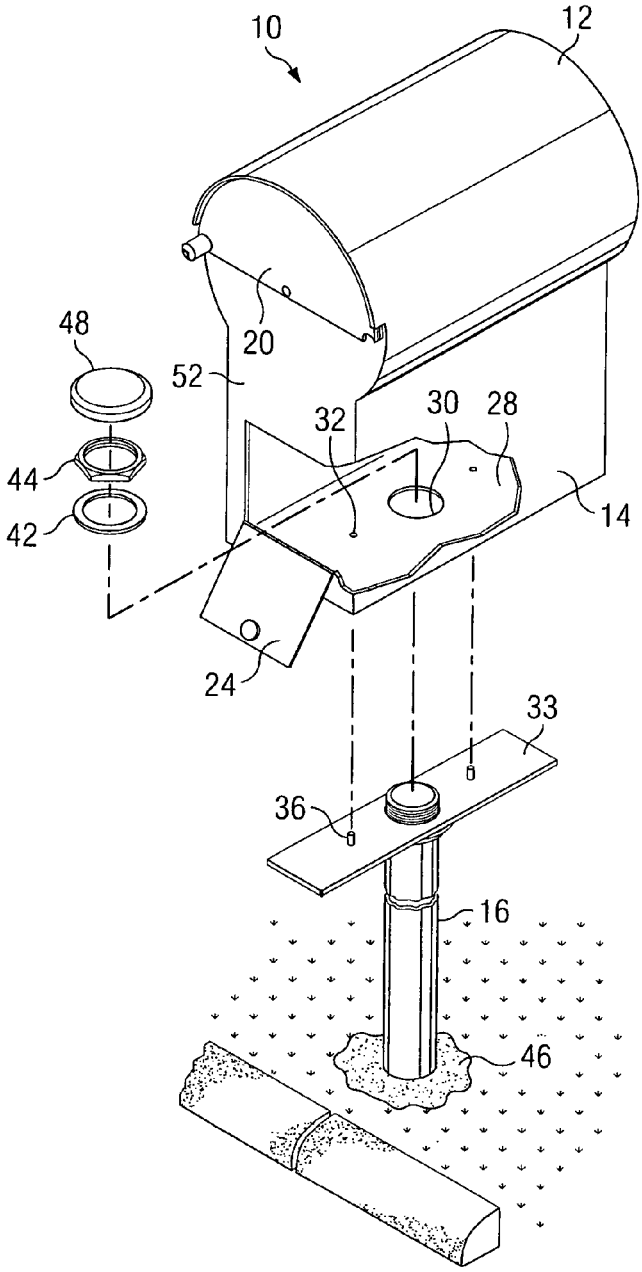

The installation of the stand 16 into the ground is shown in FIGS. 5*a*-5*c*. The base plate 33 initially functions as a handle to the auger 18 fastened to the bottom of the stand 16. The user simply rests the bottom point of the auger 18 on the ground where it is desired to install the mailbox 10. The base plate 33 is then manually rotated in a clockwise direction to auger the stand 16 into the ground and thus form a hole. During the auger process, the stand 16 is removed to empty the hole of dirt. Once the hole is sufficiently deep, for example eighteen inches deep, both the stand 16 and the auger 18 are placed in the hole. Wet cement or concrete 46 is then poured into the hole around the base of the stand 16 and around the auger 18. The stand 16 can be rotated or jostled to make sure the cement has engulfed both the auger 18 and the bottom portion of the stand 16. The stand 16 is then left until the concrete 46 has set and is cured, as shown in FIG. 5*b*.

When the concrete 46 has set, the base plate 33 is repositioned on the stand 16 so as to be perpendicular to the street or sidewalk, as shown in FIG. 5*c*. The top washer 42 and nut 44 are removed. The mailbox 10 is then lifted and placed on the base plate 33 so that the threaded part of the stand 16 protrudes through the hole 30 in the bottom 28 of the secure incoming compartment 14, in a manner such that the pins 36 attached to the base plate 33 protrude through the registration holes 32 formed in the bottom 28 of the secure incoming compartment 14. The top washer 42 is then placed over the compartment bottom 28 and over the threaded end of the stand 16. The top nut 44 is secured to the top of the stand 16. The top nut 44 is tightened so that the mailbox 10 cannot be turned with respect to the stand 16. For further securement, the hole 30 in the compartment bottom 28 can be formed as a splined opening for fitting onto a splined and threaded top of the stand 16. Lastly, a cotter pin is inserted through a hole in the top of the pipe 16 and above the nut 44. A cap 48 can be placed over the top of the threaded end of the stand 16 to prevent small mail from getting caught and to cover the vertical bore of the hollow stand 16.

Figure 3:
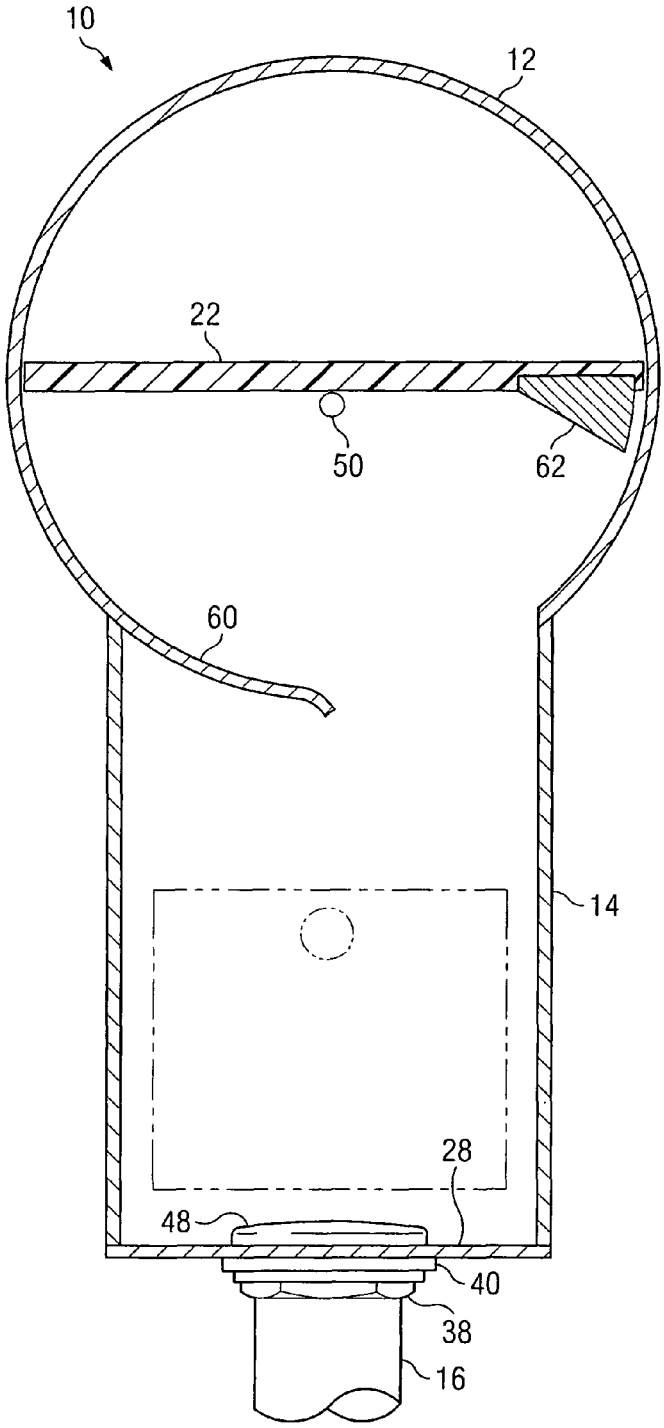
FIG. 3 is a cross-sectional view of the mail box, taken along line 3-3 of FIG. 1.
Figure 4:
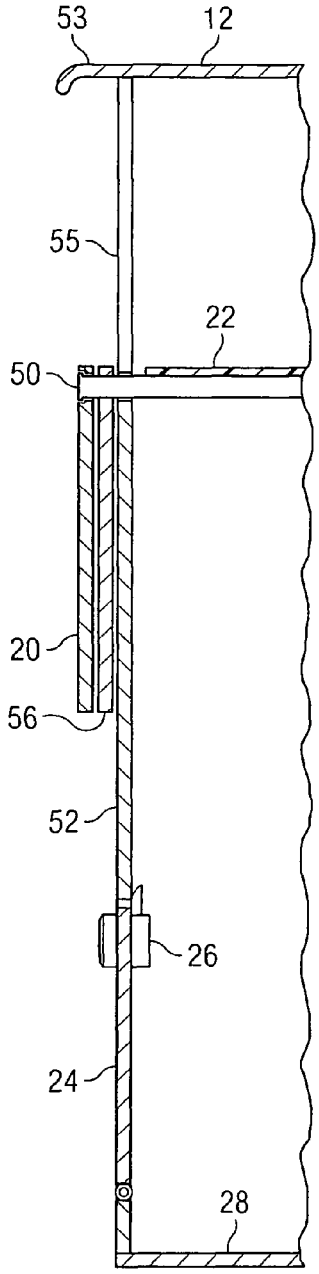
FIG. 4 is a partial cross-sectional view of the mail box, taken along line 4-4 of FIG. 1.
Figure 9:
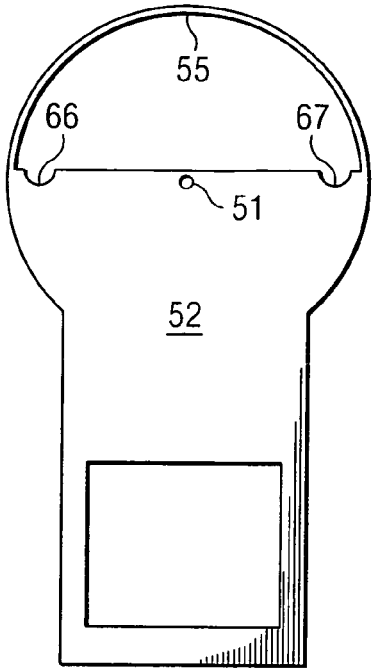
FIGS. 9 and 10 are respective frontal and back views of the mail box according to the invention.
Figure 10:
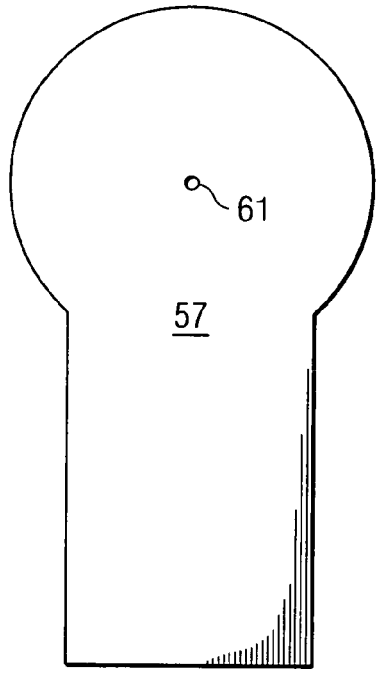

FIG. 3 illustrates a frontal cross-sectional view of the mailbox 10 according to the invention, taken along line 3-3 of FIG. 1, and FIG. 4 illustrates a side cross-sectional view of the mailbox 10, taken along line 4-4 of FIG. 1. FIG. 9 illustrates the construction of the facade 52, and FIG. 10 illustrates the construction of the rear plate 57 of the mailbox 10. As can be seen from FIG. 3, the depository vault 12 is generally cylindrical shaped, with a covered back side and a bottom which opens into the top of the secure incoming compartment 14. As shown in FIG. 9, the front of the mailbox 10 has a planar facade 52 which covers the front of the secure incoming compartment 14, except for the semicircular door opening. The facade 52 also covers the bottom half of the semicircular frontal portion of the depository vault 12. The facade 52 includes a left notch 66 and a right stop 67 in which the main door knob 58 and flag door knob 59 are cradled when rotated to the extreme positions. The facade 52 further includes a hole 51 through which a platform shaft 50 extends. Lastly, the facade 52 is constructed with a bail 55 to which the barrel portion of the depository vault 12 is fastened by tack welding, screws, rivets, or other fastening means.

Rotatably mounted within the depository vault 12 is the platform 22 on which mail rests. The platform 22 is illustrated in FIG. 3, and is shown fastened to the shaft 50 that also extends from the front to the back of the depository vault 12. The shaft 50 is mounted for rotation to the rear plate 57 (FIG. 10), as well as to the facade 52 (FIG. 9) of the mailbox 10. A bore 61 formed partially through the rear plate 57 forms a support for the end of the platform shaft 50. The front of the shaft 50 can be inserted in a hole 51 formed in the facade 52 during assembly of the mailbox 10. The semicircular-shaped main door 20 is fastened to the front end of the shaft 50. In addition, a red-colored flag door 56 has a hole therein for rotation about the platform shaft 50. Thus, when the main door 20 is rotated by use of a knob 58 (FIGS. 6*a* and 6*b*) the platform 22 rotates in a corresponding direction. The red flag door 56 can be rotated independent of the main door 20 and independent of the platform 22. The function of the flag door 56 is to provide an indication to the mailman that mail is available for pick up on the platform 22 of the rotatable vault 12 and delivery to a main post office.

Fixed to the right side of the platform 22 (FIG. 3) is a counterweight 62 to assure that the platform 22 returns to the horizontal position when the main door 20 is less than half way open, i.e. when the counterweight 62 of the platform 22 is generally between the twelve o'clock and three o'clock positions. When the platform 22 is horizontal, as shown in FIG. 3, the semicircular-shaped main door 20 does not cover the frontal semicircular opening in the top portion of the depository vault 12. When the platform 22 and main door 20 are rotated 180 degrees counterclockwise from that shown in FIG. 3, the semicircular-shaped main door 20 completely covers the top semicircular opening to the depository vault 12.

Figure 6C:
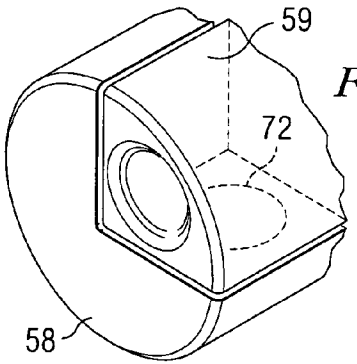
FIG. 6*c* is an enlarged isometric view of the nesting of the flag door knob in the main door knob.
Figure 6B:
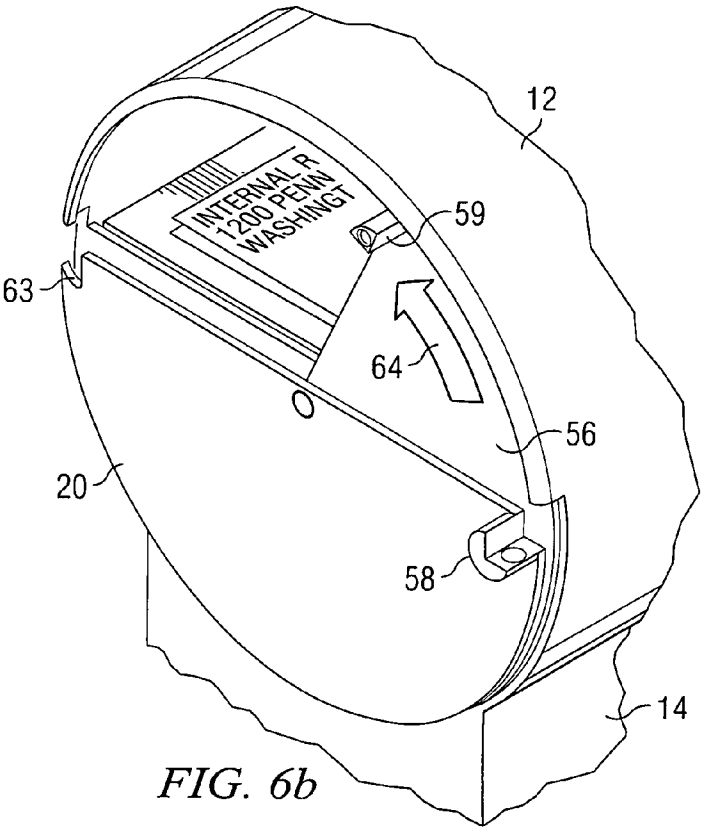
FIG. 6*b* is an isometric view of the mail box illustrating the movement of the flag door to the closed position after mail has been deposited on the rotatable platform.

According to an important feature of the invention, a security guard 60 extends over a portion of the open top of the security incoming compartment 14, as shown in FIG. 3. The security guard 60 extends from the front to the back of the mailbox 10, as a partial divider between the depository vault 12 and the secure incoming compartment 14. In addition, the security guard 60 is curved and extends laterally about half way across the top portion of the security incoming compartment 14. This is important in order to prevent an unauthorized person from opening the main door 20 of the mailbox 10 and rotating it, together with the platform 22, and reaching down into the security incoming compartment 14 and gaining access to the mail deposited therein by the postman. This feature is better understood by reference to FIG. 6*a* where the status of the main door 20 is shown in the open position. The operation of the flag door 56 is shown in FIG. 6*b*.

Figure 6A:
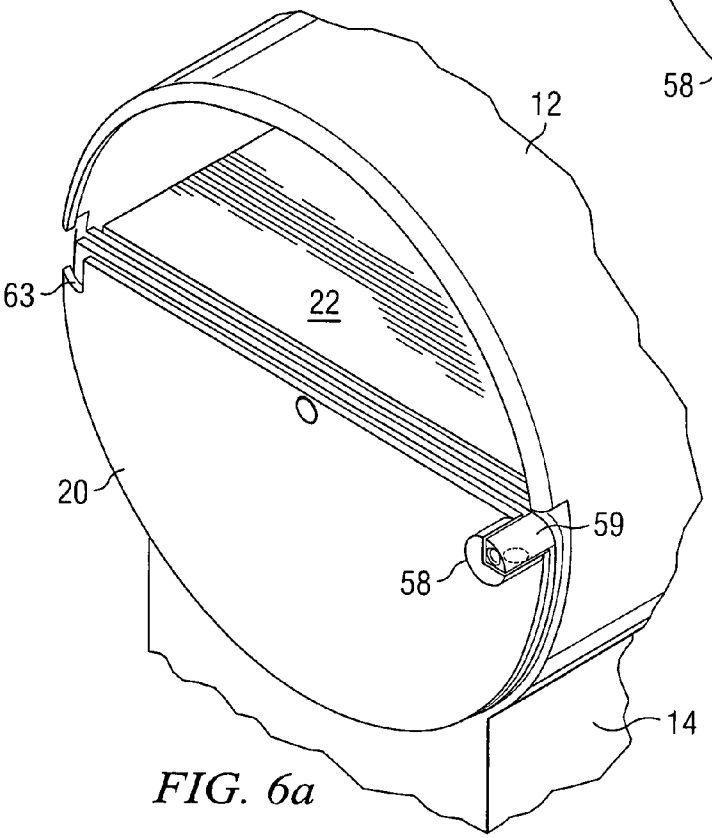
FIG. 6*a* is an isometric view illustrating the mail box with the flag door and the main door in respective open positions.

The main door 20 has a knob 58 attached thereto, and the flag door 56 has a knob 59 attached to it. The structural details of the knobs 58 and 59 are shown enlarged in FIG. 6*c*. The main door knob 58 is generally a solid cylinder with a cupped or cutout portion. The flag door knob 59 is shaped to fit within the cutout portion of the main knob 58. The relationship between the main door knob 58 and the flag door knob 59 is such that when the main door 20 is rotated CCW using the main door knob 58, the flag door 59 is carried with the main door 20 due to engagement of the flag door knob 59 within the cutout of the main door knob 58. When the main door 20 is positioned in the fully CCW or closed position, the flag door is also forced to the closed position. However, when main door 20 is open as shown in FIGS. 6*a* and 6*b*, the cutout in the main door knob 58 is oriented so as to allow the flag door knob 59 to be moved out of engagement with the main door knob 59. This allows the flag door 56 to be moved CCW to the closed position while the main door 20 remains in the fully open position.

Figure 7A:
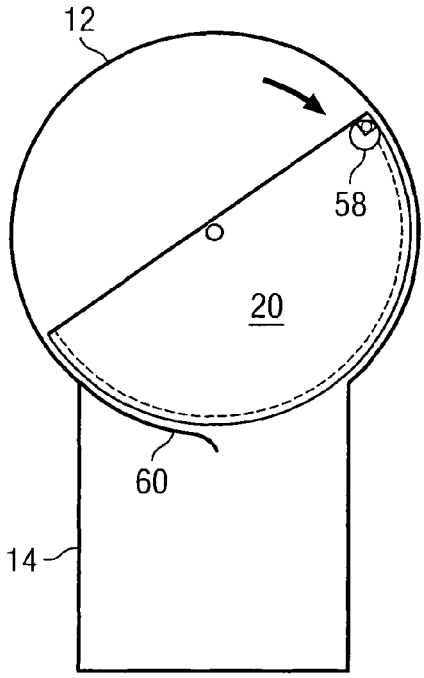
FIGS. 7*a*-7*d* are frontal views of the mail box according to the invention, with the doors rotatable in order to deposit outgoing mail on the rotatable platform.
Figure 7B:
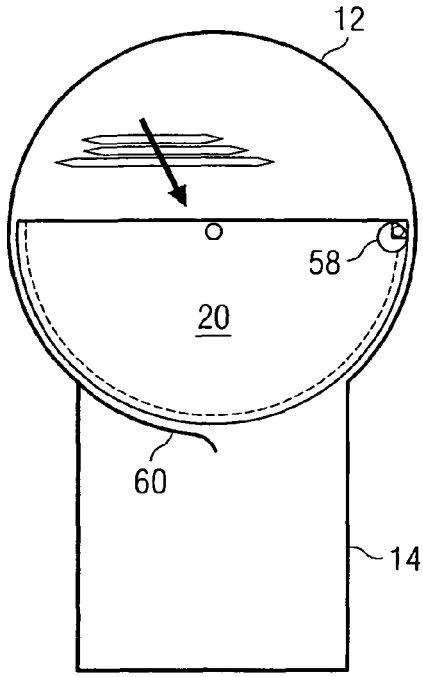
Figure 7C:
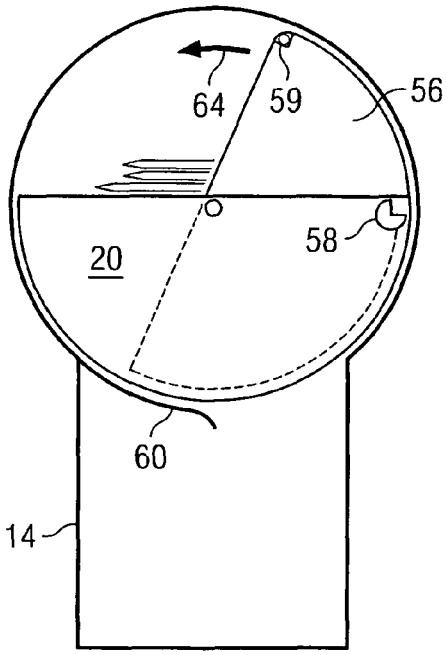
Figure 7D:
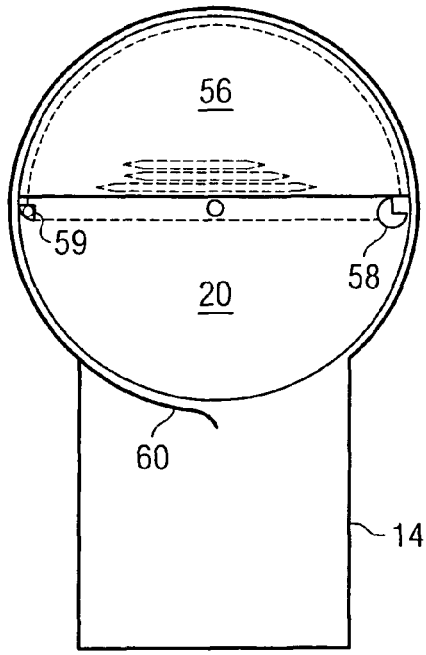

When the main door 20 is open, there is access to the platform 22 via the upper semicircular opening in the depository vault 12, as shown in FIG. 6*a*. As shown in FIG. 7*a*, both the main door 20 and the flag door 56 can be rotated CW to provide access to the platform 22. When the flag door 56 is rotated fully CCW, the knob 59 rests in a cutout 63 of the main door 20. When it is desirable to place outgoing mail in the mailbox 10 for pickup by the mailman, one need only place the mail on the horizontally-positioned platform 22 (FIG. 7*b*), and then move the flag door knob 59 counterclockwise (FIG. 7*c*). The direction of rotation of the flag door 56 is shown by arrow 64 in FIGS. 6*b* and 7*c*. This action is effective to close the top semicircular opening to the depository vault 12 (FIG. 7*d*). Preferably, the flag door 56 is colored red to indicate to the postman that mail is to be picked up from the mailbox 10. Since the flag door 56 rotates independently on the shaft 50, the flag door 56 can be moved without also rotating the platform 22. A magnet 72 can be fastened to the main door knob 58 to magnetically hold the flag door knob 59 to the main door knob 58. The magnet 72 is shown in phantom in FIG. 6*c*. When the mailman sees that the red flag door 56 is exposed, he/she can simply rotate the flag door 56 clockwise to gain access to the outgoing mail resting on the platform 22. As noted in FIG. 6*b*, the main door 20 has a notch 63 formed therein for receiving the knob 59 of the flag door 56 when the latter is rotated fully counterclockwise to the closed position.

Figure 11A:
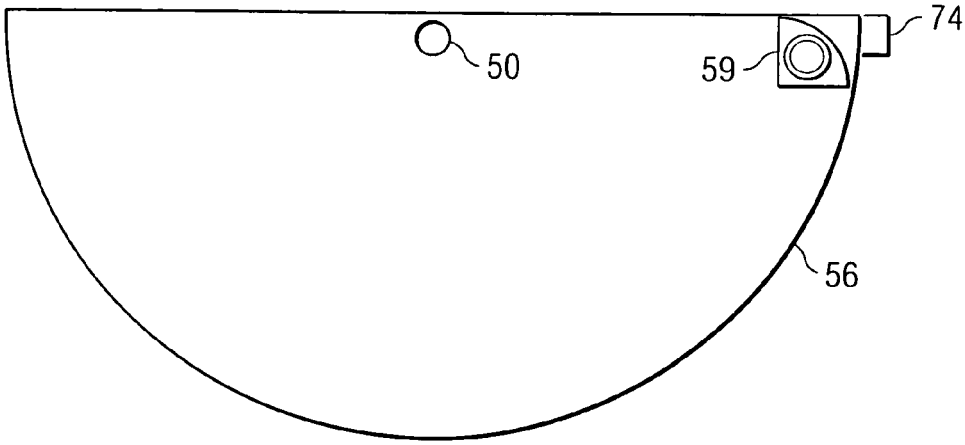
FIG. 11*a* is a frontal view of the flag door equipped with the knob and a guide.
Figure 11B:
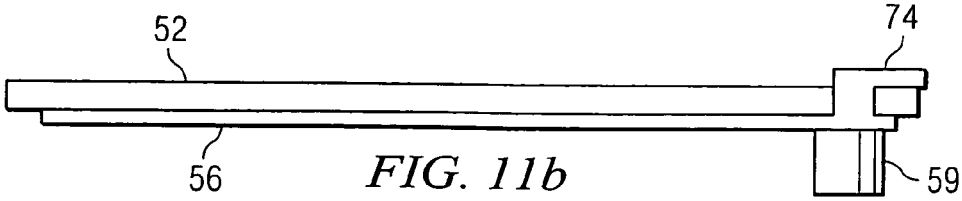
FIG. 11*b* is a top view of the flag door guide.

FIG. 11*a* illustrates the flag door 56 constructed with a guide 74. FIG. 11*b* is a top view of the flag door 56 and associated guide 74. The guide 74 is fastened to the flag door 56 and protrudes backwardly so as to engage with the horizontal edge of the planar facade 52. The guide 74 functions to prevent the flag door 56 from rotating more than 180 degrees when the main door 20 is in the closed position. In this situation, the guide 74 on the flag door 56 will catch on the horizontal edge of the planar facade 52 and stop further rotation of such door 56. When the main door 20 is rotated to the open position, the flag door 56 is prevented from rotating more than 180 degrees by engagement of the flag door knob 59 with the notch 63 in the main door 20.

The receiving of incoming mail to the mailbox 10 is shown in FIGS. 8*a*-8*d*. Preferably, the main door 20 has been previously rotated counterclockwise to its closed position in FIG. 8*a*. This position of the main door 20 closes the semicircular opening to the depository vault 12 to keep rain, snow and the like out of the mailbox 10. As another protection against the weather, a rain guard 53 is provided over the front, top portion of the mailbox 10. The rain guard 53 is curled to prevent rain, snow and the like from entering into the closed or open mailbox 10. Any rain, snow or the like which may accumulate on the rain guard 53 will drip or fall off instead of falling into the semicircular opening of the mailbox 10. The details of the rain guard 53 are shown in FIG. 4.

Figure 8A:
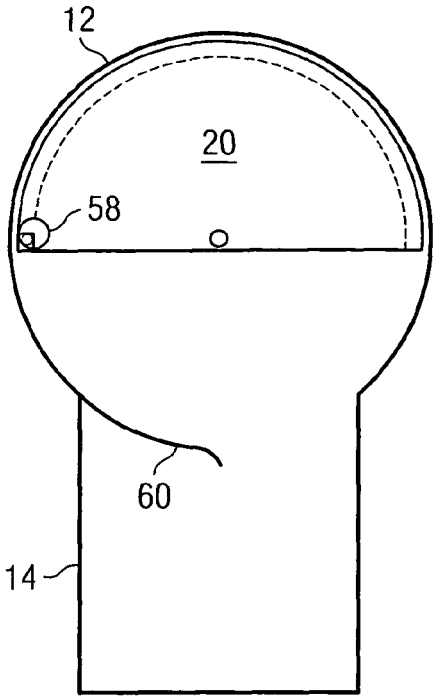
FIGS. 8*a*-8*d* are frontal views of the mail box according to the invention, with the doors rotated in order to receive incoming mail and drop the mail into the underlying secure compartment.
Figure 8B:
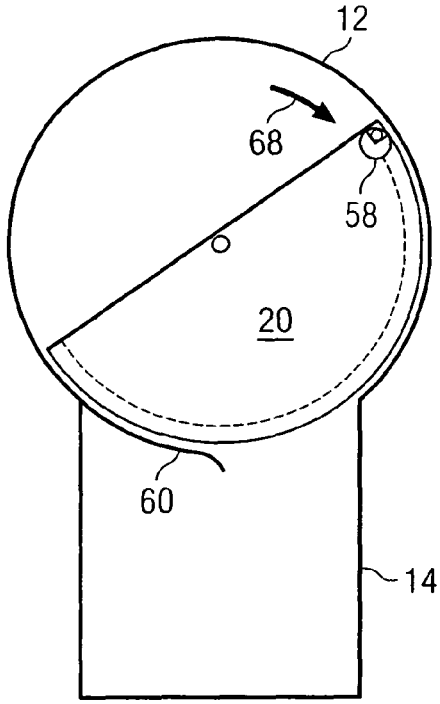
Figure 8C:
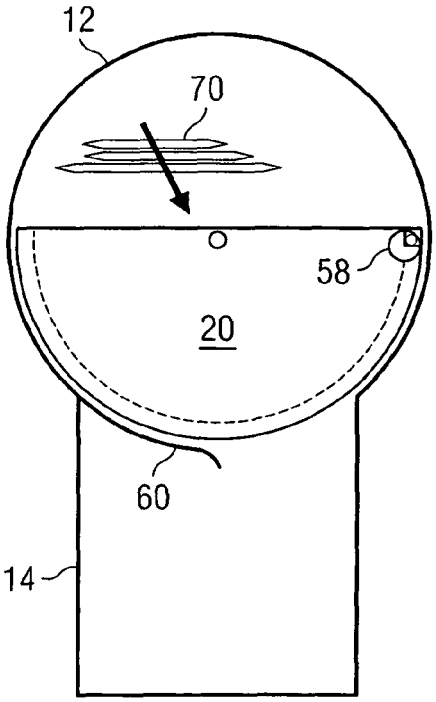
Figure 8D:
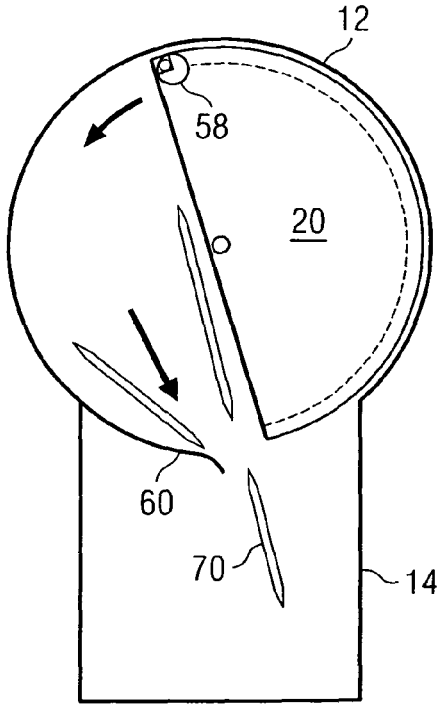

Returning to FIGS. 8*a*-8*d*, when the postman has incoming mail to be delivered to the mailbox 10, the postman simply rotates the main door 20 clockwise using the knob 58, as shown by arrow 68 in FIG. 8*b*, to provide access to the depository vault 12, and more particularly the platform 22. The incoming mail 70 is deposited by the postman on the platform 22 inside the depository vault 12. This is shown in FIG. 8*c*. Next, the postman grasps the main door knob 58 and rotates it counterclockwise to thereby rotate the platform 22 and the main door 20 in a corresponding direction. As a result, the platform 22 rotates as shown in FIG. 8*d*, whereupon the incoming mail 70 drops into the secure incoming compartment 14 which underlies the depository vault 12. In the fully counterclockwise position, the main door 20 closes the semicircular opening in the depository vault 12.

It is important to understand that when the main door 20 and platform 22 have been rotated to the CCW position shown in FIG. 8*d* to deposit the incoming mail in the secure incoming compartment 14, there is limited access from outside the mailbox 10 through the depository vault 12 to the secure incoming compartment 14. This limited access is achieved because in this position, the main door 20 substantially closes the semicircular opening to the depository vault 12, and there is very little space between the edge of the security guard 60 and the platform 22. These two restrictions to the security incoming compartment 14 prevent a person from reaching in from the outside of the mailbox 10 with his/her arm, or an object, and attempting to retrieve the mail previously deposited in the secure incoming compartment 14. In any event, once the mailman has rotated the main door 20, and thus the platform 22 to the fully counterclockwise position to deposit the incoming mail in the secure incoming compartment 14, the main door 20 is left in the closed position, again to prevent rain from entering into the internal portions of the mailbox 10. The counterweight 62 assists in closing the main door 20 and keeping such door 20 closed, when in the 11:00 o'clock and 9:00 o'clock positions.

In order to retrieve the incoming mail, an authorized person inserts a key in the lock 26 to unlock the compartment door 24 so as to have access to the mail deposited in the secure incoming compartment 14 by the postman. Once the mail is retrieved, the compartment is again locked so as to provide a secure compartment 14. The compartment door 24 and lock 26 can be located in the front of the secure compartment 14, as shown, or alternatively in the back or in either side of the secure compartment 14.

From the foregoing, disclosed is a mailbox having a secure incoming compartment to receive mail. A main door is made rotatable with a platform on which mail is laid, so that the rotation of the main door also rotates the platform to automatically deposit the mail to the secure compartment as well as close the opening to the depository vault. A flag door is also provided and made rotatable to cover and uncover the opening in the rotatable vault to provide an indication to the postman that outgoing mail is on the platform, as well as close the opening to the depository vault.

A number of the mailboxes described above can be constructed and fastened side-by-side in a row for servicing a number of customers. Multiple mailboxes could be mounted on a single stand, or two spaced-apart stands can be anchored in the ground with a beam spanning the stands. A number of mailboxes could then be mounted to the beam.

Figure 12:
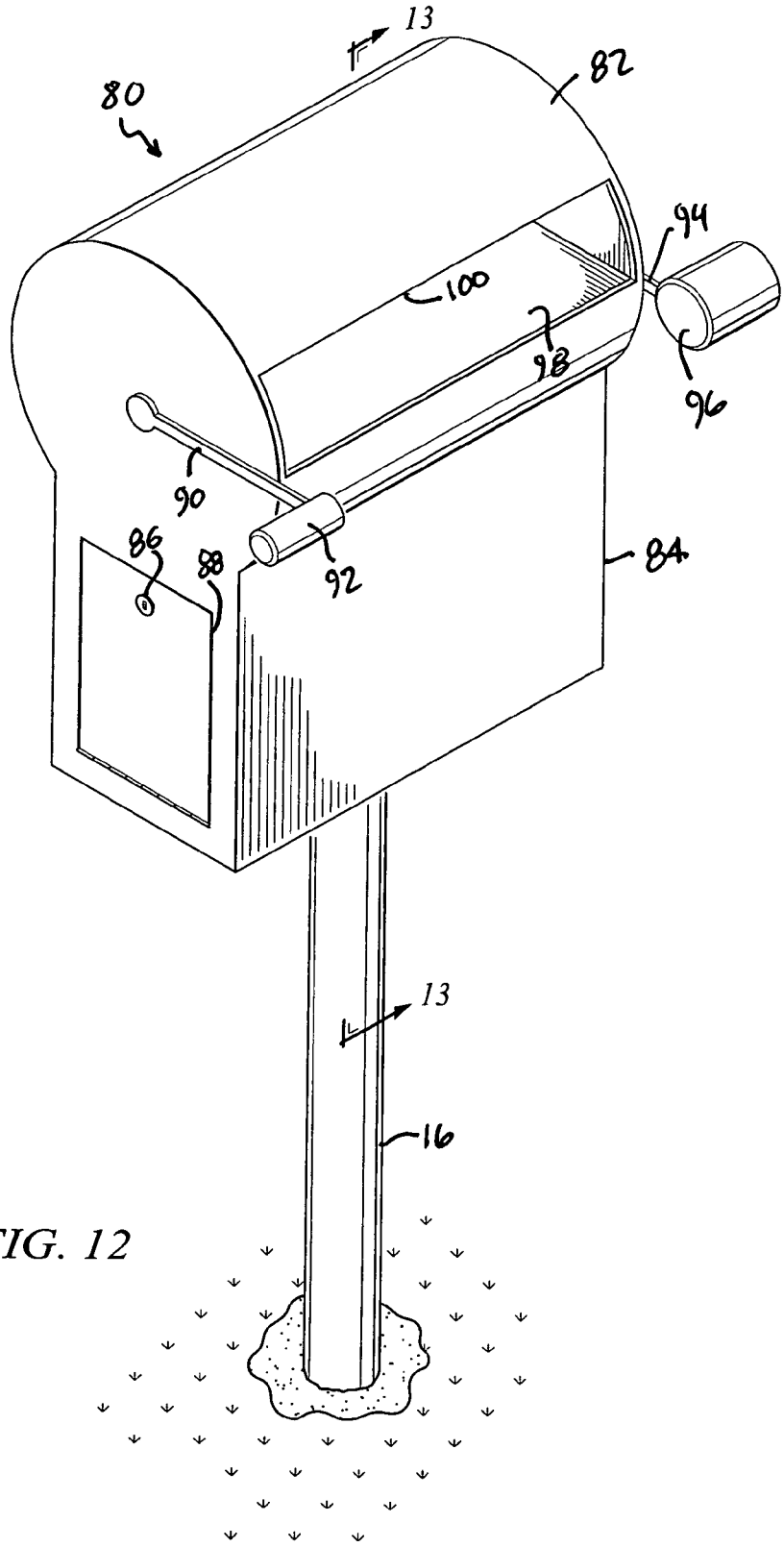
FIG. 12 is an isometric view of a mail box constructed according to another embodiment of the invention.

Illustrated in FIG. 12 is a mail box 80 constructed according to another embodiment of the invention. The mailbox 80 includes a barrel-shaped depository vault 82, and a secure incoming compartment 84 attached to the bottom of the depository vault 82. With this arrangement, incoming mail can be deposited in the depository vault 82 by the postman, and dropped into the secure incoming compartment 84. At a later time a person can retrieve the incoming mail from the secure compartment 84 by unlocking a lock 86 and opening a door 88 to gain access to the mail in the secure incoming compartment 84. Outgoing mail can be deposited in the depository vault 82 by a person, and later retrieved therefrom by the postman. The mail box 80 is fastened to a stand 16 in the same manner described above in connection with the mail box 10 of FIG. 1.

The mail box 80 is constructed of metal or other durable material. A mail deposit handle 90 is connected to a mail deposit knob 92, and when operated, a mail platform 98 internal to the depository vault 82 is rotated so that any incoming mail deposited thereon is dropped into the secure incoming compartment 84. While not shown in FIG. 12, the base of the mail deposit handle 90 is connected by an axial rod to the mail platform 98 so that the platform 98 can be rotated about a central axis extending through the barrel-shaped depository vault 82. In order to transfer the incoming mail from the mail platform 98 to the secure incoming compartment 84, the postman need only deposit the incoming mail through the opening 100 in the depository vault 82 onto the platform 98, and rotate the mail deposit handle 90 in a counter-clockwise manner, as viewed in FIG. 12. Moreover, and as will be described in more detail below, when the mail deposit handle 90 is rotated, a bottom portion 120 of the mail platform also rotates and covers the opening 100 to prevent a person from reaching into the internal portion of the depository vault 82.

The operation of the mail box 80 for outgoing mail is carried out by depositing outgoing mail on the platform 98 by a person, and rotating the flag handle 94 counter-clockwise to rotate a flag door (not shown in FIG. 12) to close the mail box opening 100. The outside surface of the flag door is painted red so that the red color flag door that covers the opening 100 is clearly visible and provides an indication to the postman that outgoing mail is ready to be picked up. With the flag door covering the opening 100, rain and other weather elements are prevented from entering the internal part of the mail box 80. A lateral lip, gutter or shield (not shown) can be placed on the depository vault 82 above the opening 100 to prevent rain and the like from entering the vault 82. The mail deposit knob 92 is of a different size as compared to the flag door knob 96, so that the two are easily distinguished. Moreover, the flag door knob 96 can be painted a color different from that of the mail deposit knob 92.

Figure 13:
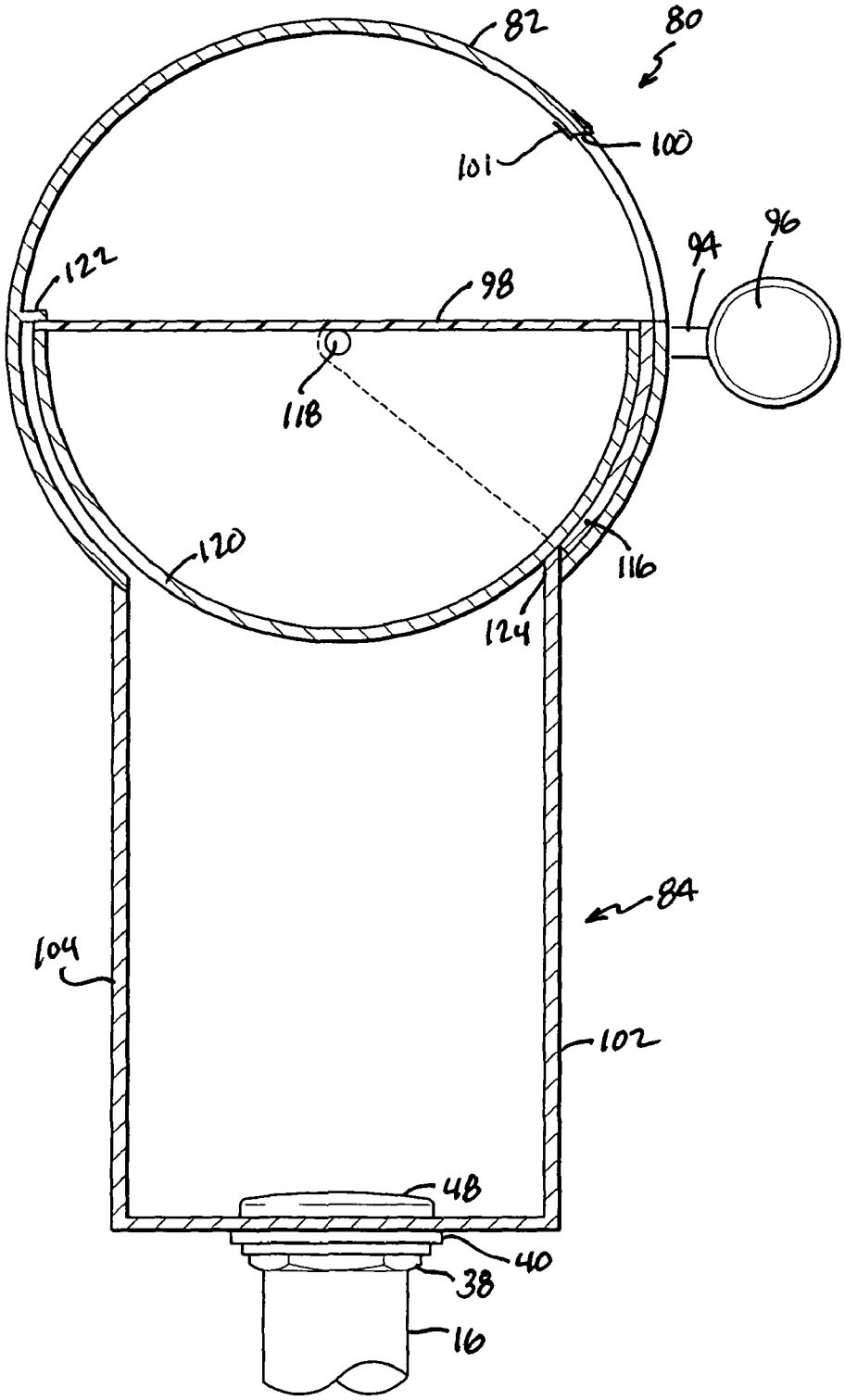
FIG. 13 a cross-sectional view of the mail box, taken along line 13-13 of FIG. 12.

FIG. 13 is a cross-sectional view of the mail box 80, illustrating the relative positions of the mail platform 98 and the flag door 116 when the handles 90 and 94 are rotated to the respective CW rest positions. The mail platform 98 is in a horizontal position, as shown, when at a first rest position. The mail deposit handle 90 is also horizontal and directed toward the front of the mail box 80 when in the first rest position, as shown in FIG. 12. The mail platform 98 is fastened to an axle rod 118. The axle rod 118 extends through the bore 110 formed in the left side panel 106 (FIG. 14) of the mail box 80. The mail platform 98 is constructed as half of a cylinder, with a semi-cylindrical bottom portion 120 and closed sides 99. The horizontal portion of the platform 98 can be welded to the semi-cylindrical portion 120 and sides 99. Formed on the internal wall of the depository vault 82 is a lateral stop 122. The stop 122 prevents rotation of the mail platform 98 beyond the stop 122. It should be noted that the platform 98 is fastened to the axle rod 118 so that the first rest position of the mail platform 98 is as shown, with the flat or planar surface being horizontal and oriented upwardly in the depository vault 82. The mail deposit handle 90 is fastened to the axle rod 118 so that the clockwise rotation tendency thereof due to the weight of the handle 90 and knob 92 causes the back edge of the platform 98 to abut against the bottom of the stop 122. When the platform 98 is abutted against the stop 122, as shown in FIG. 13, the mail deposit handle 90 is generally horizontal and directed forwardly, as shown in FIG. 12.

In the preferred embodiment, the mail depository handle 90 can be rotated counter-clockwise about 100 degrees, to a second rest position, namely an over-center position. When rotated to such position to transfer incoming mail to the secure compartment 84, the mail platform 98 and the handle 90 will remain in the stable 100 degree position, until manually rotated clockwise to the first rest position in which the mail platform 98 and the handle 90 are both horizontal. A portion of the semicylindrical bottom portion 120 functions as a door to close the opening 100 in the depository vault 82 when the handle 90 and knob 92 are rotated CCW to the extreme second rest position. The portion of the semicylindrical bottom 120 of the mail platform that closes the opening 100 prevents a person from attempting to retrieve mail from the secure incoming compartment 84 via the opening 100. It can be seen that the mail platform 98 is balanced about the axle rod 118, except for the existence of the mail deposit handle 90 and knob 92, which can be weighted to achieve desired operations.

According to an important feature of the invention, the arcuate distance or height of the opening 100 in the depository vault 82 is about the same distance between the stop 122 and the junction where the compartment side 104 is joined to the bottom edge of the barrel-shaped depository vault 82. Thus, as the mail platform 98 is rotated CCW, the back edge of the mail platform 98 does not begin to open into the secure incoming compartment 84 until the frontal edge of the platform 98 closes off the opening 100 to the depository vault 82. With this arrangement, a person cannot reach into the secure incoming vault 84 via the opening 100 in the depository vault 82.

The flag door 116 is constructed as an arcuate-shaped panel, and in the rest position, the flag door 116 is nested between the outer surface of the semi-cylindrical shaped portion 120 of the mail platform, and the inner surface of the depository vault 82. The position in which the flag handle 94 is connected to the flag door 116 causes the flag door 116 to be biased to the rest position shown. A channel-shaped strip of rubber weather stripping 101 is wrapped around the top edge of the opening 100. The part of the weather stripping 101 inside the depository vault 82 functions to wedge the flag door 116 when in a closed position. In other words, the weather stripping 101 maintains the flag door 116 in the closed position due to friction. Much like the mail deposit handle 90, the flag door handle 94 is positioned horizontally and directed forwardly in a rest position. The weight of the flag door handle 94 causes clockwise rotation of the flag door 116 until stopped by stop 124. The flag door stop 124 is a portion panel 102 of the secure incoming compartment 84 that extends upwardly into the rotational path of the flag door 116.

Figure 14:
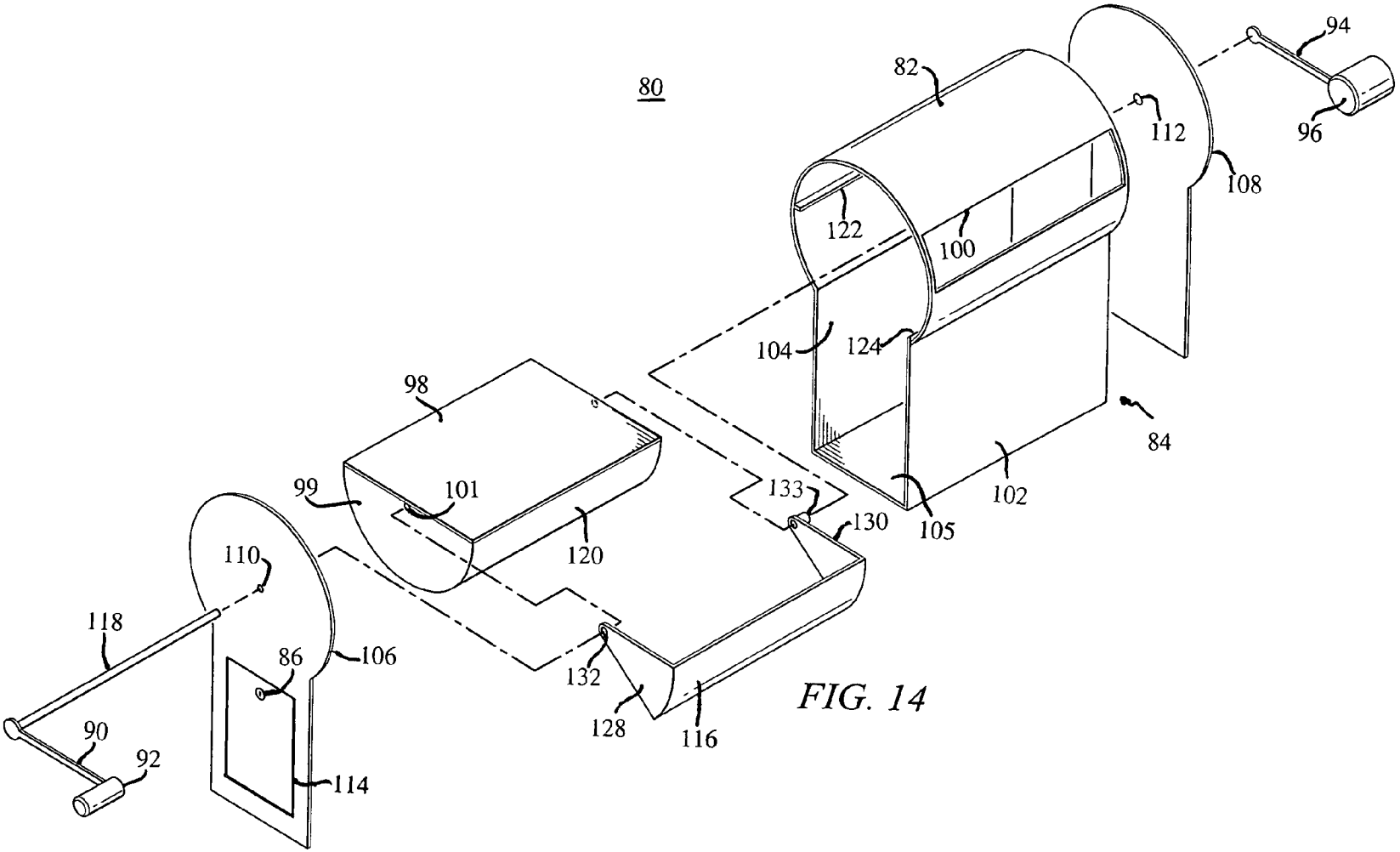
FIG. 14 is an exploded view of the mail box of FIG. 12, illustrating the structural features and assembly of the mail platform and the flag door.

FIG. 14 is an exploded view of the mail box 80, which illustrates the detailed construction of the various components thereof. The depository vault 82 is constructed with a barrel-shaped body and a bottom mail drop opening, and a side mail deposit opening 100. The secure incoming compartment 84 is located under the mail drop opening of the mail depository vault 82. The barrel-shaped body of the depository vault 82 is cylindrical shaped, with the opposing planar ends. The right and left planar ends of the depository vault 84 are made integral with the respective right and left end panels of the secure incoming compartment 84. The secure incoming compartment 84 includes a bottom panel 105 to which the stand 16 is fastened.

The planar mail platform 98 is made integral to the semi-cylindrical part 120, as well as to the opposing semicircular sides, one shown as numeral 99. The axle rod 118 is attached to both the mail deposit handle 90 and the platform 98. Each semi-circular side 99 includes a hole 101 therein through which the axle rod 118 extends. The axle rod 118 is preferably welded to each platform side 99. While the mail platform 98 is constructed with closed sides 99, the opposite ends could be open, in which event the axle rod 118 would be welded to the undersurface of the platform 98.

As noted above, the flag door 116 is constructed with an arcuate-shaped panel that extends substantially across the width of the depository vault 82, and can be rotated to close the opening 100. The arc subtended by the panel 116 is about ninety-eight degrees, but could be other heights. Fastened to the arcuate-shaped panel 116 are end brackets 128 and 130. The end bracket 128 has a bore 132 through which the axle rod 118 freely extends. The other bracket 130 includes a tubular axle or stub 133 through which the axle rod 118 freely extends. The tubular stub 133 is welded to the bracket 130 and is rotatable around the axle rod 118. The end of the axle rod 118 extends through the tubular stub 133 and through the bore 112 formed in the right side of the mail box panel 108. The flag door handle 94 is fixed to the tubular stub 133 of the flag door 116. It can be appreciated that the flag door 116 is made pivotal about the axle rod 118. As note above, the height of the arcuate flag door panel 116 is larger than the corresponding height of the opening 100 in the depository vault 82.

It can be seen that the mail deposit handle 90 is fixed to the axle rod 118, which is fixed to the mail platform 98. The flag door handle 94 is fixed to the flag door 116 by way of the tubular stub 133. Thus, the mail platform 98 can be operated independently of the flag door 116, and vice versa.

Figure 15A:
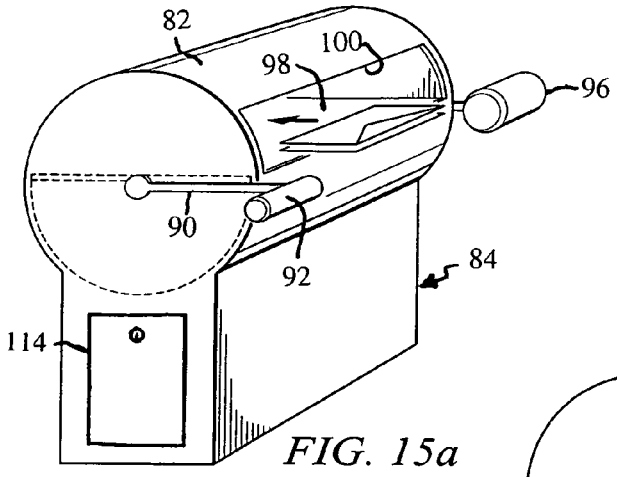
FIG. 15*a* and FIG. 15*b* are isometric views of the mail box of FIG. 12, with the doors operated to receive outgoing mail.
Figure 15B:
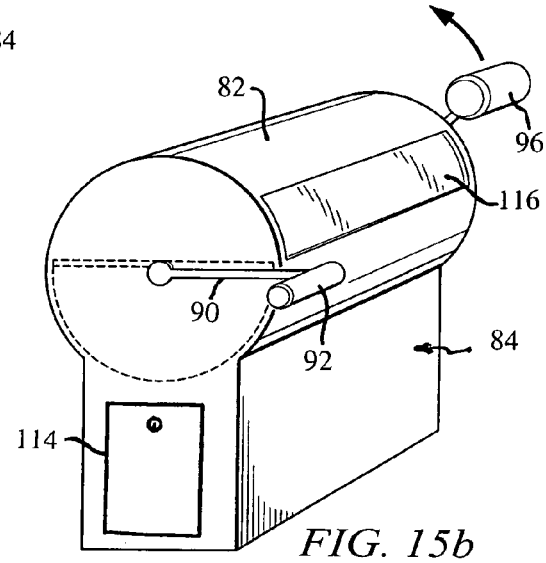

FIGS. 15*a* and 15*b* illustrate the operation of the mail box 80 to process outgoing mail, i.e. mail that is deposited in the mail box 80 and will be subsequently picked up by the postman. First, the user of the mail box 80 will make sure that both knobs 92 and 96 are moved to the horizontal rest positions, as shown in FIG. 15*a*. This state of the mail box 80 assures that the mail platform 98 is horizontal and that the flag door 116 does not obstruct the opening 100 in the depository vault 82. The person can thus deposit outgoing mail onto the horizontal mail platform 98. Once the outgoing mail is laid on the mail platform 98, the flag door knob 96 can be rotated upwardly so that the flag door 116 closes the opening 100 in the depository vault 82, as shown in FIG. 15*b*. The red-painted outer surface of the flag door 116 is thus highly visible to signal the postman that outgoing mail is present in the mail box 80.

In order to facilitate the security of outgoing mail, the mail box 80 can be equipped with a mechanism to lock the mail deposit handle 90 in the horizontal position when the flag door 116 and thus the flag door handle 94 are in the up position. Otherwise, the mail deposit handle 90 could be inadvertently rotated and accidentally deposit the outgoing mail in the underlying secure incoming compartment 84. It is envisioned that a ball catch mechanism' would engage in the rod 118 from the tubular stub 133 of the flag door 116, or in the angle the flag door goes up it would encroach upon the space needed to rotate the platform 98, thus not allowing it to move unless the flag door 116 is in the down position.

Figure 16A:
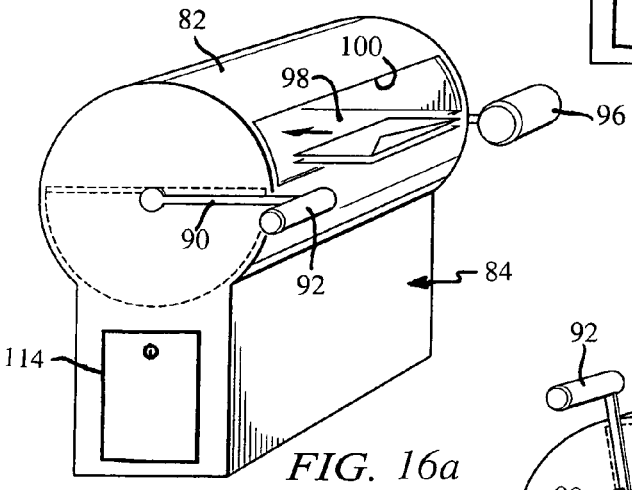
FIGS. 16*a* and 16*b* are isometric views of the mail box of FIG. 12, with the doors operated in order to receive incoming mail and drop the mail into the underlying secure compartment.
Figure 16B:
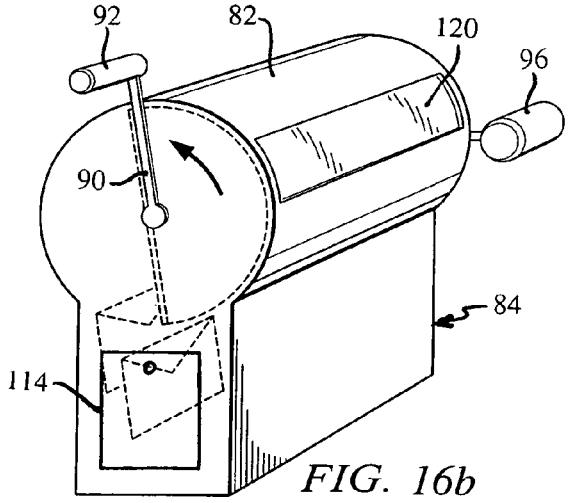

FIGS. 16*a* and 16*b* illustrate the operation of the mail box 80 to process incoming mail, i.e. mail that is deposited in the mail box 80 by the postman and transferred to the secure incoming compartment 84 by the postman. The postman positions the knobs 92 and 96 to the rest positions, as shown by FIG. 16*a*. This assures that the mail platform 98 is horizontal and that the flag door 116 is removed from the opening 100. The postman then deposits the incoming mail onto the platform 98, rotates the mail deposit knob 92 CCW or upwardly to the second rest position, as shown in FIG. 16*b*. This rotation of the mail deposit knob 92, and thus the handle 90, is effective to rotate the mail platform 98 to drop the incoming mail into the secure incoming compartment 84. Once the incoming mail has been deposited into the secure incoming compartment 84, the postman can leave the mail deposit knob 92 in its fully rotated CCW position, as shown in FIG. 16*b*. In this second rest position, the semi-cylindrical portion 120 of the platform functions as a door to close the opening 100 in the depository vault 82. The upraised mail deposit knob 92 is a signal to the user of the mail box 80 that incoming mail is present. The user can then unlock the door 114 to the secure incoming compartment 84 and retrieve the mail. The user can also leave the knob 92 in the second rest position to maintain the depository vault opening 100 covered and prevent rain, snow and the like from entering the depository vault 84.

From the foregoing, disclosed is a mail box that includes a mail depository vault for receiving mail, from which outgoing mail can be picked up by the postman, or from which incoming mail can be deposited into a secure incoming compartment for later retrieval by the user of the mail box. The mail box includes a mail deposit handle/knob to operate a mail platform to deposit incoming mail into the secure incoming compartment, and at the same time function as a door to close the opening in the mail box. A flag door handle/knob operates a flag door to also close the opening in the mail box to signal the postman that outgoing mail is present on the mail platform. The closed flag door is colored red to facilitate the state of the presence of outgoing mail in the mail box. The mail deposit handle/knob and the flag door handle/knob can be operated independently of each other, depending on the state of the mail in the mail box.

While the preferred and other embodiments of the invention have been disclosed with reference to a specific mailbox, it is to be understood that many changes in detail may be made as a matter of engineering choices without departing from the spirit and scope of the invention, as defined by the appended claims.

What is claimed is:

1. A mail box, comprising:

a barrel-shaped depository vault having a cylindrical body with closed ends, said cylindrical body having a bottom mail drop opening and a mail deposit opening in the cylindrical body for depositing mail in said depository vault;

a secure incoming compartment underlying the bottom mail drop opening, said secure incoming compartment including a door for retrieving mail from said secure incoming compartment;

an arcuate-shaped flag door rotatable about an axis to open and close the mail deposit opening in the cylindrical body of said depository vault;

a mail platform rotatable about the same axis as said arcuate-shaped flag door, said mail platform located to receive mail thereon via said mail deposit opening in said cylindrical body of said depository vault, a cylindrical portion attached to said mail platform, and said cylindrical portion adapted for covering said mail deposit opening in said cylindrical body when said mail platform is rotated to drop mail from said mail platform into the underlying said secure incoming compartment;

a flag door handle attached to said flag door for rotating said flag door; and a mail deposit handle attached to said mail platform to rotate said mail platform.

2. The mail box of claim 1, further including an axle rod extending between the closed ends of said barrel-shaped cylindrical body, said mail platform fixed to said axle rod and rotatable therewith.

3. The mail box of claim 2, wherein said mail platform includes a planar platform which extends substantially across a diameter of said cylindrical body of said depository vault, and extends substantially between the closed ends of said depository vault.

4. The mail box of claim 3, wherein said cylindrical portion is a semi-cylindrical portion, and said mail platform is planar, and said semi-cylinder portion is attached to said planar mail platform.

5. The mail box of claim 4, wherein said semi-cylindrical portion of said mail platform substantially fills a bottom portion of the cylindrical body of said depository vault.

6. The mail box of claim 4, wherein said flag door is located so as to be nested in a rest position between an inner cylindrical surface of said cylindrical body and the semi-cylindrical portion of said mail platform.

7. The mail box of claim 2, further including a pair of brackets attached orthogonal to opposite ends of said arcuate-shaped flag door, said brackets each including a bore through which said axle rod freely extends so that said flag door rotates about said axle rod but independent of movement of said axle rod.

8. The mail box of claim 7, wherein one said bracket includes a tubular stub with a bore therein through which said axle rod freely extends.

9. The mail box of claim 8, wherein said flag door handle is fastened to the tubular stub of the one said bracket of said flag door.

10. The mail box of claim 1, wherein said flag door handle is rotatable without rotating said mail platform.

11. The mail box of claim 1, wherein said flag door handle is located adjacent one closed end of said depository vault, and said mail deposit handle is located adjacent an opposing closed end of said depository vault.

12. The mail box of claim 11, wherein the flag door handle is rotatable about the same axis as said mail deposit handle.

13. A mail box, comprising:

a flag door handle;

a mail deposit handle;

a first axle;

a second axle;

a barrel-shaped depository vault having opposing first and second side panels, said first axle extending from a bore in said first side panel, and said mail deposit handle attached to said first axle, and said second axle extending from a bore in said second side panel, and said flag door handle attached to said second axle;

a secure incoming compartment underlying a mail drop opening in said depository vault;

a mail platform attached to said first axle, said mail platform having a planar surface extending diametrically within said barrel-shaped depository vault, said mail deposit handle effective to rotate said mail platform and transfer mail from said mail platform to said secure incoming compartment; and a flag door operable by said flag door handle for covering and uncovering a mail deposit opening in said barrel-shaped depository.

14. The mail box of claim 13, wherein said mail platform and said flag door are rotatable about a common axis.

15. The mail box of claim 13, wherein an outside surface of said flag door is painted red to indicate outgoing mail in the depository vault of said mail box.

16. The mail box of claim 13, wherein said mail platform is rotatable independently of said flag door.

17. The mail box of claim 13, wherein said flag door is rotatable independently of said mail platform.

18. The mail box of claim 13, wherein said mail deposit handle and said mail platform attached thereto include two stable rest positions, one stable rest position where the mail platform is horizontal, and a second stable rest position where the mail platform remains rotated after mail has been dropped into said secure incoming compartment.

19. A method of using a mail box, comprising:

rotating a mail platform of said mail box to uncover a mail deposit opening in said mail box, thereby allowing mail to be deposited via said mail deposit opening onto the mail platform located within a depository vault of said mail box;

depositing outgoing mail onto the mail platform and rotating a flag door to a closed position to close the mail deposit opening in said mail box;

moving the flag door to the open position to retrieve the outgoing mail deposited on the platform; and depositing incoming mail on the mail platform and rotating the mail platform to thereby drop the incoming mail into a secure compartment located below said depository vault, and leaving the mail platform in the rotated position so that a portion of the mail platform closes the mail deposit opening.

20. The method of claim 19, further including moving the flag door without moving the mail platform, and and moving the mail platform without moving the flag door.

* * * * *